US007135261B2

(12) United States Patent
Yamazaki

(10) Patent No.: US 7,135,261 B2
(45) Date of Patent: Nov. 14, 2006

(54) MULTI-LAYERED ORGANIC ELECTROPHOTOGRAPHIC PHOTOCONDUCTOR

(75) Inventor: Mikio Yamazaki, Nagano (JP)

(73) Assignee: Fuji Electric Imaging Device Co., Ltd., Nagano (JP)

( * ) Notice: Subject to any disclaimer, the term of this patent is extended or adjusted under 35 U.S.C. 154(b) by 53 days.

(21) Appl. No.: 10/645,879

(22) Filed: Aug. 22, 2003

(65) Prior Publication Data

US 2004/0126688 A1 Jul. 1, 2004

(30) Foreign Application Priority Data

Aug. 26, 2002 (JP) ..... 2002-245876
Jul. 3, 2003 (JP) ..... 2003-191016

(51) Int. Cl.
*G03G 5/047* (2006.01)

(52) U.S. Cl. ..... 430/59.2; 430/59.4; 430/60; 430/96

(58) Field of Classification Search ..... 430/59.1, 430/59.2, 59.4, 59.5, 60, 96, 64, 65
See application file for complete search history.

(56) References Cited

U.S. PATENT DOCUMENTS 2,297,691 A 10/1942 Carlson
3,791,826 A * 2/1974 Cherry et al. ..... 430/65
3,816,118 A 6/1974 Byrne
3,825,422 A 7/1974 Gruber et al.
4,518,669 A * 5/1985 Yashiki ..... 430/57.1
5,066,557 A * 11/1991 Robinette et al. ..... 430/59.4
5,302,479 A * 4/1994 Daimon et al. ..... 430/78
5,312,708 A * 5/1994 Terrell et al. ..... 430/59.6
5,393,629 A * 2/1995 Nukada et al.
5,677,096 A * 10/1997 Suzuki ..... 430/58.75
5,759,726 A * 6/1998 Tambo et al. ..... 430/59.4
6,180,301 B1 * 1/2001 Mayo et al. ..... 430/59.3
6,355,390 B1 * 3/2002 Yamanami et al. ..... 430/60

FOREIGN PATENT DOCUMENTS

JP 03-010256 * 1/1991
JP 05-232716 9/1993
JP 6-208238 7/1994
JP 08-030005 2/1996
JP 09-258468 10/1997
JP 11-271991 10/1999
JP 2002-107972 4/2002

OTHER PUBLICATIONS

Japanese Patent Office machine-assisted English language translation of JP 2002-107972 (pub. Apr. 2002).*
USPTO English-language translation of JP 2002-107972 (pub. Apr. 10, 2002).*
Weast, R.C., et al., ed., *CRC Handbook of Chemistry and Physics*, 48th edition, The Chemical Rubber Co., Ohio,(1967), p. B-177.*
Grant, R., et al., ed., *Grant & Hackh's Chemical Dictionary*, 5th edition, McGraw-Hill Book Company, NY (1987), p. 277.*
Japanese Patent Office English abstract describing JP 03-010256, copyright 1998, 2003.*
American Chemical Society (ACS) on STN abstract Acc. No. 1991:438641, describing JP 03-10256, entered STN Jul. 21, 1991.*

* cited by examiner

*Primary Examiner*—Janis L. Dote

(57) ABSTRACT

A multi-layered organic electrophotographic photoconductor exhibits superior stability in mass production and excellent adhesion ability with two layers contacting the charge generation layer and is free of contamination of the coating liquid for a charge transport layer during a dip-coating process due to dissolution of the charge generation layer. The multi-layered organic electrophotographic photoconductor includes a conductive substrate and layers including an undercoat layer containing a thermosetting resin, a charge generation layer containing a charge generation material and an organic binder resin, and a charge transport layer laminated sequentially on the substrate, wherein polydispersity defined by a ratio of a weight average molecular weight to a number average molecular weight of the organic binder resin is at least 4.0, and the weight average molecular weight is at least $7.0\times10^4$ in a distribution of a polystyrene-converted molecular weight obtained by gel permeation chromatography.

5 Claims, 1 Drawing Sheet

MULTI-LAYERED ORGANIC ELECTROPHOTOGRAPHIC PHOTOCONDUCTOR

CROSS-REFERENCE TO RELATED APPLICATIONS

This application claims the benefit of Japanese Application Nos. 2002-245876, filed Aug. 26, 2002, and 2003-191016, filed Jul. 3, 2003, in the Japan Patent Office, the disclosures of which are incorporated herein by reference.

BACKGROUND OF THE INVENTION

1. Field of the Invention

The present invention relates to a multi-layered organic electrophotographic photoconductor comprising an undercoat layer and principal functional layers of a charge generation layer and a charge transport layer, and particularly relates to an organic binder resin used in the charge generation layer.

2. Description of the Related Art

Various types of electrophotographic photoconductors have been developed since the invention of C. F. Carlson, U.S. Pat. No. 2,297,691. The electrophotographic photoconductors include inorganic photoconductors and organic photoconductors. An inorganic photoconductor uses an inorganic photoconductive material such as amorphous silicon, selenium, selenium-tellurium compound, selenium-arsenic compound, or zinc oxide. A type of an organic photoconductor comprises laminated layers of a charge generation layer and a charge transport layer. The charge generation layer contains charge generation material mainly composed of a photoconductive functional material of an organic pigment such as phthalocyanines or azo compounds that is dissolved or dispersed in an organic binder resin. The charge transport layer contains charge transport material functioning transporting electrons or holes generated in the charge generation layer upon receipt of light to the surface of the charge transport layer. The charge transport material is dissolved or dispersed in an organic binder resin. The charge generation layer and the charge transport layer are function-separated lamination-type organic thin films formed on a cylindrical conductive substrate using a coating liquid containing dissolved or dispersed charge generation or charge transport materials mentioned above.

In the case of an organic electrophotographic photoconductor of a function-separated type mentioned above, the charge generation layer and the charge transport layer are normally formed through an undercoat layer over a conductive substrate, and are occasionally laminated directly on the substrate. The underlayer is sometimes formed by an alumite layer that is an anodized film of aluminum, as in the case of an aluminum substrate. However, an inexpensive organic resin is often used for laminating the undercoat layer to conserve cost. The charge generation layer is a very thin film with a thickness of at most about 1 μm and is formed by dispersing the above-mentioned pigment particles in an organic binder resin. The charge transport layer is formed by dissolving a charge transport material with a relatively low molecular weight in an organic binder resin such as polycarbonate resin to provide a molecular dispersion state. The thickness of the charge transport layer is usually in the range from 10 μm to 30 μm.

Semiconductor lasers and light emitting diodes are often used in printers, digital copiers, facsimile machines, and digital image complexes that perform these functions together. The semiconductor laser and light emitting diodes emit light with a wavelength in the range from 635 to 780 nm, which is longer than the main wavelength of a white light source that is commonly used as a light source for photoconductors. Consequently, photoconductors having sensitivity to the light with such long wavelengths are needed and have been developed. For example, the phthalocyanines mentioned previously exhibit a larger value of absorbance in the wavelength range emitted by semiconductor lasers than other charge generation materials. In addition, the phthalocyanines exhibit an excellent charge generation capability in this wavelength range. Consequently, the phthalocyanines have been extensively studied for use as a charge generation material of photoconductors carried on above-mentioned apparatuses employing a light source of a semiconductor laser.

The known phthalocyanines that exhibit excellent charge generation capability in the long wavelength range include the compounds having a central metal of copper, aluminum, indium, vanadium, or titanium as disclosed in Japanese Unexamined Patent Application Publication Nos. S53-89433 and S57-145748, and U.S. Pat. Nos. 3,816,118 and 3,825,422.

In the apparatuses of analog copiers using a white light source, for example, a halogen lamp, mainly used are multi-layered organic electrophotographic photoconductors using a charge generation material of a bisazo compound having a sensitivity in the wavelength range of 400 to 650 nm or a trisazo compound having a sensitivity in the longer wavelength range.

Electrical characteristics generally required by a photoconductor are good chargeability, little dark decay, and low residual potential, and endurance of these characteristics during repeated use, as well as the charge generation function upon receipt of light. An organic photoconductor with a structure of function-separated laminated organic thin films, in particular, needs sufficient adhesion ability between the organic thin film and a conductive substrate, and between the organic thin films. The adhesion ability is essential to secure photoconductive characteristic, mechanical strength, and image quality. When a photoconductor has a structure provided with an undercoat layer, in which a charge generation layer is sandwiched by upper and lower organic thin films, selection of the organic binder resin to bind pigment particles in the organic layer is quite important to attain superior adhesion ability with the adjacent organic thin films. A charge generation layer cannot achieve a desired level of the electrical characteristics required by a photoconductor as described above if an organic binder resin in the charge generation layer does not have a sufficient adhesion ability with the conductive substrate or with the upper and lower organic thin films.

With miniaturization and cost reduction of a body of apparatuses such as printers in recent years, a radius of a cylindrical conductive substrate of a photoconductor is decreasing, which in turn is increasing stress in the organic photoconductor. Accordingly, more enhancement of adhesive force is required between layers in the photosensitive layer and between the cylindrical substrate and the photosensitive layer. Moreover, levels of electrical characteristics are required that cannot be achieved without provision of an undercoat layer on a substrate. In order to meet requirements of the market, an undercoat layer formed of an organic resin is increasingly employed in place of an expensive alumite layer, aiming at cost reduction. If a poly(vinyl acetal) resin that has been developed as a resin exhibiting excellent adhesion ability with a surface of a metallic substrate is used for an organic binder resin in a charge generation layer formed on a resin undercoat layer, the adhesion ability of the resin of the charge generation layer with the underlayer made of an organic resin becomes apparently insufficient.

Undercoat layers formed of organic resin may be one of two types. A type of an undercoat layer is formed of organic resin alone. Another type of an undercoat layer formed of an organic resin contains additives of fine particles of a metal oxide to adjust electric characteristics of the photoconductor by controlling a conductivity of the undercoat layer and avoiding image defects in a form of an interference fringe generated by a multiple reflection of exposure light. If a charge generation layer is formed using an organic binder resin of poly(vinyl acetal) on either type of the undercoat layer, formed of resin material containing a thermosetting resin in particular, the charge generation layer exhibits rather poor adhesion ability in comparison with a charge generation layer formed directly on a conductive substrate of aluminum.

SUMMARY OF THE INVENTION

An aspect of the present invention is to provide a multi-layered organic electrophotographic photoconductor that exhibits excellent adhesion ability with two layers contacting the charge generation layer and is free of contamination of the coating liquid for a charge transport layer during a dip-coating process due to dissolution of the charge generation layer and exhibits superior stability in mass production.

A dip-coating method is generally employed for forming laminated photosensitive layers of an organic photoconductor because of a superior productivity. A thermosetting resin with setting temperature of 130° C. or more cannot be used for the charge generation layer because electrical performances of the photoconductor deteriorate. Even if such a resin is used, proper treatment at the most suitable setting temperature is difficult. Consequently, the surface of the charge generation layer does not exhibit enough strong resistance to a solvent. As a result, there arises a problem that in the next step of coating a charge transport layer, the already formed charge generation layer dissolves into the coating liquid for the charge transport layer and contaminates the coating liquid. If the contaminated coating liquid is continued to be used for repeatedly forming charge transport layers, the electrical characteristics of the produced photoconductors gradually change, and finally deviate from the specified normal range, or the external appearance, such as the color tone of the product varies and differs from the standards. Thus, a problem occurs in the stability in mass production.

As described above, a multi-layered organic electrophotographic photoconductor involves technical problems about adhesion ability between the charge generation layer and the adjacent layers, and the contamination of the coating liquid to form a charge transport layer by dip-coating, as well as adverse effects of the contamination on electrical performance.

In view of the above, an aspect of the present invention is to provide a multi-layered organic electrophotographic photoconductor comprising a charge generation layer that exhibits excellent adhesion ability with an undercoat layer and with a charge transport layer, and is free of contamination of the coating liquid to form a charge transport layer by the dip-coating method due to dissolving of the charge generation layer, to achieve stability in mass production.

The above aspect is attained by a multi-layered organic electrophotographic photoconductor comprising a conductive substrate and layers including an undercoat layer containing thermosetting resin, a charge generation layer containing a charge generation material and an organic binder resin, and a charge transport layer laminated in the cited order on the substrate, wherein the polydispersity defined by a ratio of weight average molecular weight to number average molecular weight of the organic binder resin is at least 4.0, and the weight average molecular weight is at least $7.0\times10^4$ in a distribution of polystyrene-converted molecular weight obtained by gel permeation chromatography.

Advantageously, the binder resin of the charge generation layer is substantially composed of poly(vinyl acetal) represented by the following chemical formula (1),

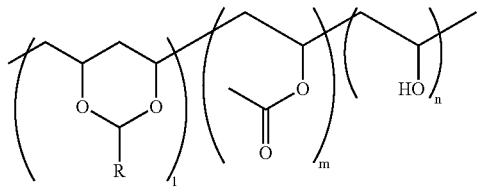

(1)

where l, m, and n are integers, and R is an alkyl group of one or more carbons or a hydrogen atom.

Advantageously, the binder resin of the charge generation layer is substantially composed of a mixture of two or more types of the poly(vinyl acetal) that have different weight average molecular weights and have an overlapping range in molecular weight distributions.

Advantageously, a ratio of the weight of the charge generation material to the weight of the binder resin in the charge generation layer is in the range from 7/3 to 5/5.

Advantageously, the undercoat layer further contains fine particles that perform the functions of scattering exposure light and transporting photo-generated charges to the substrate.

In a multi-layered organic electrophotographic photoconductor according to an embodiment of the present invention, the organic binder resin having the above-specified polydispersity of molecular weight distribution is preferably a mixture of two or more types of organic binder resins because such a mixture allows easier control at a proper polydispersity of molecular weight distribution, although a single type of the binder resin may be used. Specific examples of a preferred mixture of two or more types of organic binder resins can be found in a proper combination of derivatives of the poly(vinyl acetal) represented by the general formula (1). In order to achieve excellent adhesion ability of the charge generation layer compatible with avoiding dissolution of the charge generation layer into a coating liquid to form a charge transport layer by a dip-coating method, it is preferable to mix a plurality of poly(vinyl acetal) having a low molecular weight and having a medium to a high molecular weight in an appropriate ratio and to adjust to the above-specified molecular weight distribution. Such a mixture is also favorable in view of the stability in mass production. The following describes preferred embodiments of multi-layered organic electrophotographic photoconductors using the poly(vinyl acetal) derivative. However, other resins may be used in the photoconductor of the invention.

An electrophotographic photoconductor according to embodiments of the invention comprises a charge generation layer including an organic binder resin that has the specified polydispersity and the specified weight average molecular weight. Such a photoconductor has the effect of improving an adhesion ability between the photosensitive layers and the effect of preventing the charge generation layer from being dissolved in the process of dip-coating for the charge transport layer. The reason for these effects may be considered as follows.

Effect of Terminal Groups

The effects of improving adhesion ability and avoiding dissolution are closely related to the adhesive property of the organic binder resin of the charge generation layer according to an embodiment of the invention. In general, adhesive strength of a polymer resin adhesive agent is greatly affected by the number of hydroxy groups in particular, the number of hydroxy groups in the terminal groups, in the structural formula of the adhesive agent. A resin with a low molecular weight exhibits superior adhesive strength in comparison with a resin with a high molecular weight because the former includes a larger number of terminal groups.

A description is set forth below of poly(vinyl butyral) that is a type of the poly(vinyl acetal) involved in an embodiment of the present invention. The poly(vinyl butyral) is obtained by butyralizing poly(vinyl alcohol) that is produced by hydrolysis of poly(vinyl acetate). The yields of the reactions do not reach 100% and the terminal groups that are primarily obtained are a hydroxy group, an acetoxyl group, and a carboxyl group. The three types of groups all exhibit a large polarity and may contribute to adhesion ability, while the effect of each on the adhesive strength is different. Although the effects of the above-cited three types of terminal groups cannot be simply compared, the number of terminal groups per unit mass is larger in the low molecular weight resin than in the high molecular weight resin, assuming equal probability of producing the three types of terminal groups independently of the molecular weight of the resins. As a result, a resin with the lower molecular weight may be considered to exhibit superior adhesive strength.

Effect of Hydrogen Bonds Within a Molecule

A compound with a high molecular weight has a high probability to form a hydrogen bond between hydroxy groups within the molecule by accessing each other due to bending of the molecule. Although molecules may move freely in a solution, the liquid is condensed in the process of film formation and each molecule takes on a bent or a folded structure. As a result, a lump of such a molecule has a rather small number of hydroxy groups that are exposed to a surface, and make it possible to interact with other molecules. On the other hand, a compound with a relatively low molecular weight has a low probability to form a hydrogen bond between hydroxy groups within a molecule and ceases contributing to adhesion. Therefore, a compound with a low molecular weight exhibits a superior adhesive strength than a compound with a high molecular weight. A weight ratio of the charge generation material (called "pigment" below) to the organic binder resin in a charge generation layer is preferably in a range from 7/3 to 5/5 as indicated previously. The reason is described below.

If the weight proportion of the pigment with respect to the weight of the total solid component of the charge generation layer using an organic binder resin is larger than 7/10, the amount of the resin is not sufficient to separate the pigment particles and accomplish dispersion stability in the coating liquid for the charge generation layer, resulting in aggregation of the pigment, followed by sedimentation of bulky pigment lumps. When the coating liquid contains lumps, troubles occur such as faults in the coated film. Further, when a charge transport layer is to be laminated by the dip-coating method on the charge generation layer that is formed with a pigment ratio larger than 7/10, contamination of the coating liquid for the charge transport layer by dissolution of the charge generation layer becomes significant.

On the other hand, the pigment ratio smaller than 5/10 causes a failure to attain a necessary sensitivity and an increase in running potential variation, such as residual potential elevation during continuous printings. Thus, an excellent quality of a coating film and favorable electrical performance may be achieved by using an organic binder resin of poly(vinyl acetal) in particular, and controlling the proportion of the solid components of the charge generation layer so that the weight ratio of pigment/resin is in the range from 7/3 to 5/5.

BRIEF DESCRIPTION OF THE DRAWING

A multi-layered organic electrophotographic photoconductor according to embodiments of the present invention will be described below in detail with reference to the accompanying drawing. The invention, however, shall not be limited to the exemplified embodiments.

DETAILED DESCRIPTION OF THE PREFERRED EMBODIMENTS

Figure 1:
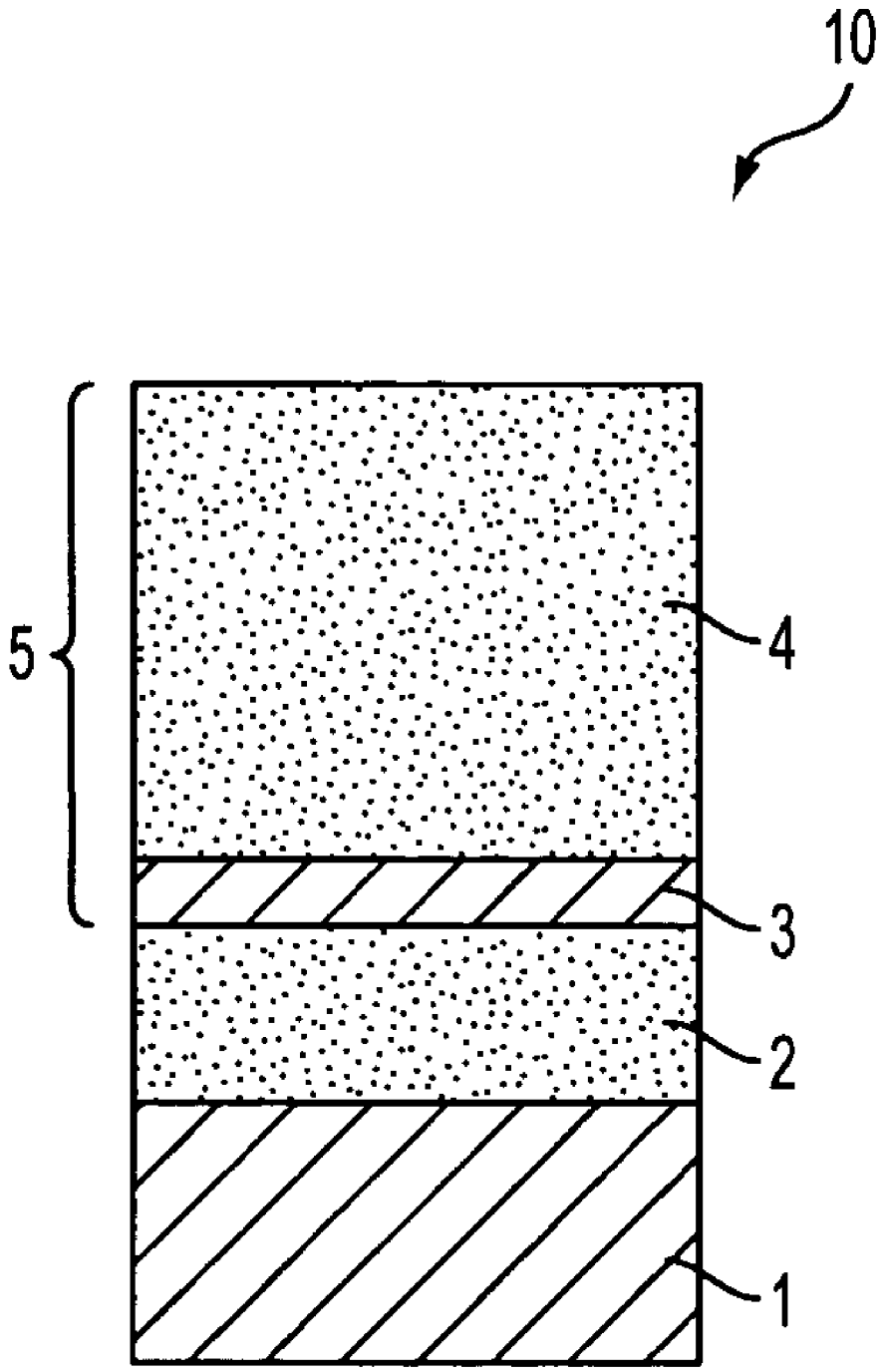
FIG. 1 is a schematic cross sectional view of a multi-layered organic electrophotographic photoconductor according to an embodiment of the present invention.

FIG. 1 is a schematic cross sectional view of a multi-layered organic electrophotographic photoconductor 10 according to an embodiment of the present invention. Current layered organic electrophotographic photoconductors generally have a substrate layer as a support layer and two active layers. These active layers generally include (1) a charge generation layer containing a light absorbing material, and (2) a charge transport layer containing electron donor molecules. The active layers may be arranged in any order, and sometimes can be combined in a single or a mixed layer. In an embodiment of the present invention, an undercoat layer 2, a charge generation layer 3, and a charge transport layer 4 are sequentially formed on a conductive substrate 1 in the order recited. The photosensitive layer 5 includes a combination of the charge generation layer 3 and the charge transport layer 4.

A conductive substrate may be a cylinder of a metal such as aluminum, or a conductive plastic film. Likewise, glass, and moldings and sheets of acrylic resin, polyamide, and poly(ethylene terephthalate) provided with electrodes may be used.

An undercoat layer may be made of a material selected from a thermosetting resin including melamine and epoxy, an insulating polymer including casein, poly(vinyl alcohol), poly(vinyl acetal), nylon, and cellulose, a conductive polymer including polythiophene, polypyrrole, polyphenylene vinylene, and polyaniline, and one of those polymers containing a metal oxide, for example, titanium oxide or zinc oxide, or other fine particles that perform functions of scattering exposed light and transporting photo-generated charges to the substrate.

A charge generation material used in the charge generation layer may be selected from phthalocyanine compounds and bisazo compounds. A benzene ring(s) in the structural-formula of the phthalocyanine compounds may have a substituent, for example, a halogen atom or an occasionally substituted alkyl group. The core of the phthalocyanine compound may be a transition metal or a heavy metal, for example, copper, aluminum, indium, vanadium, titanium, or tin, or an oxide or a halide of these metals.

The organic binder resin in the charge generation layer of embodiments of the invention is often used in combination with the phthalocyanine compound. However, the binder resin may be used in combination with a bisazo compound, as well.

Specific examples of such bisazo compounds will be shown later. Although the phthalocyanine compounds and the bisazo compounds exhibit polymorphism, embodiments of the present invention are not limited to any specific crystal form. The phthalocyanine compound has preferably undergone dispersion treatment and has a grain size under 300 nm, more preferably less than 200 nm in the coating liquid for the charge generation layer. The following gives specific examples of a structural formula of the phthalocyanine compounds and bisazo compounds that may be used for charge generation material.

(2-2)

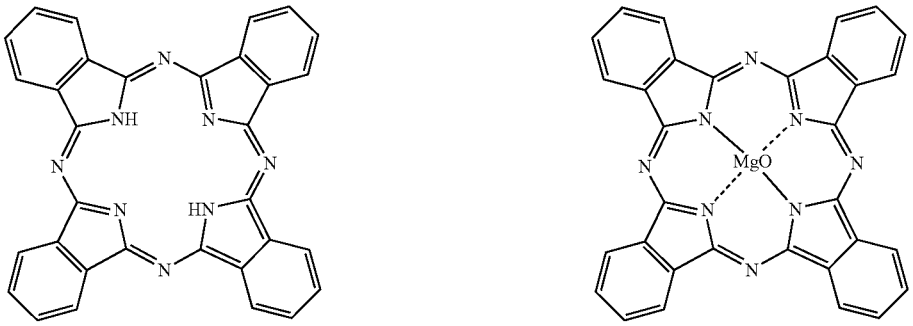

(2-4)

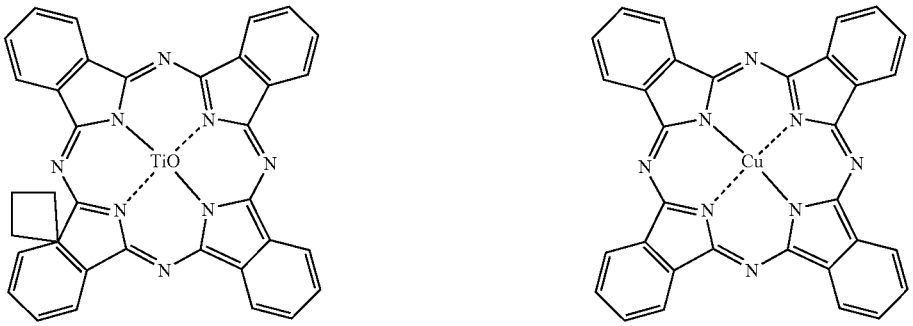

(2-6)

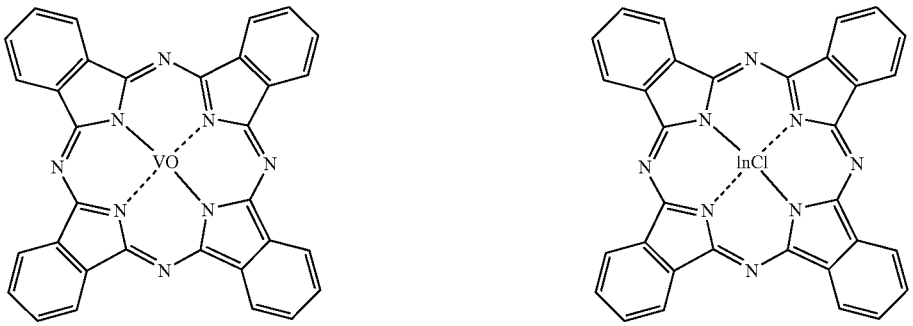

(2-7)

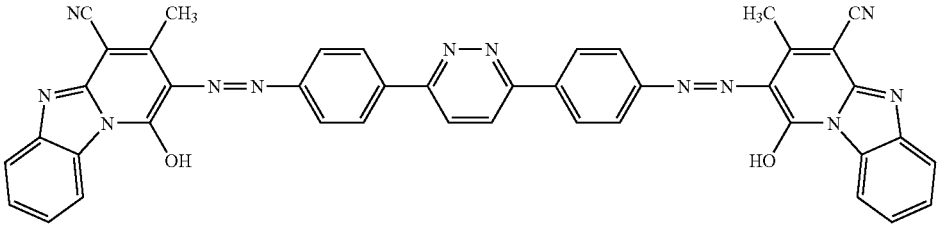

(2-8)

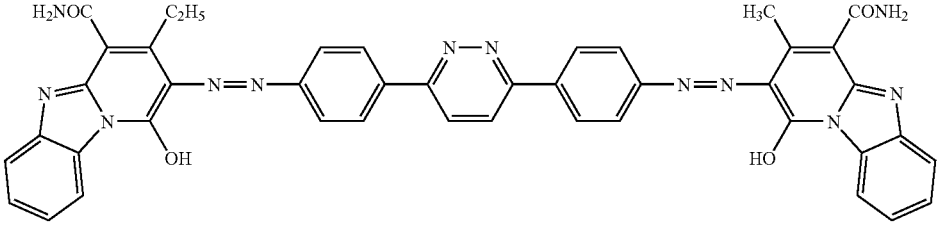

-continued
(2-9)
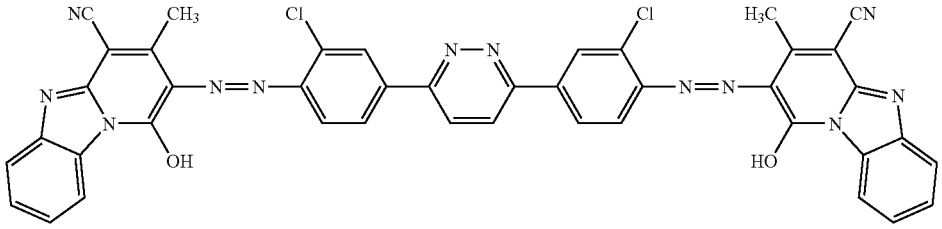
(2-10)
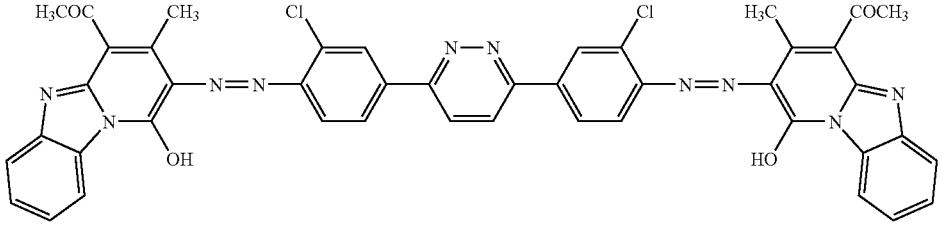
(2-11)
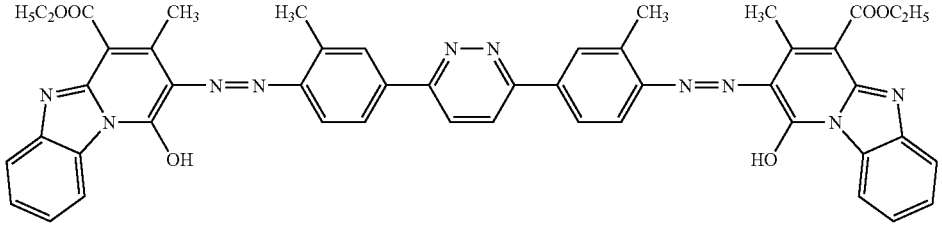
(2-12)
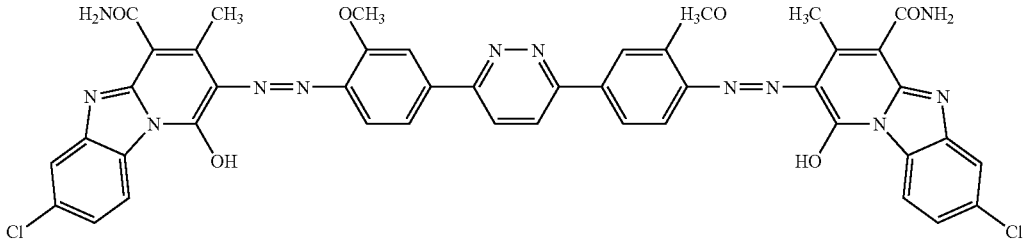
(2-13)
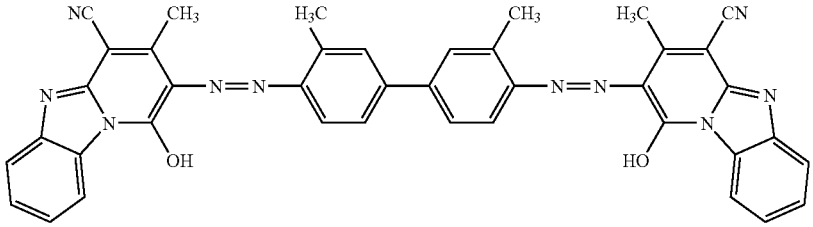
(2-14)
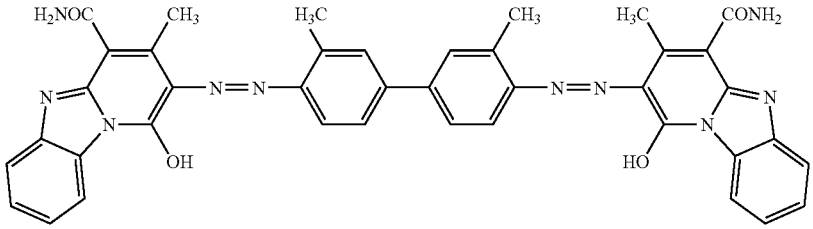

-continued
(2-15)
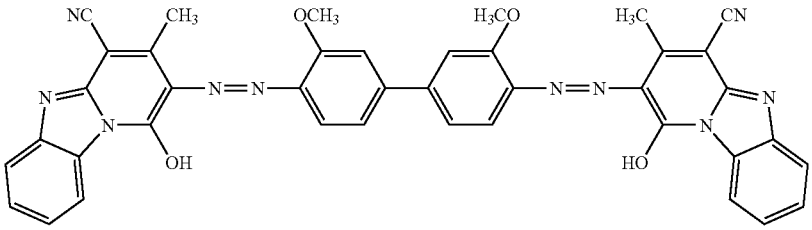
(2-16)
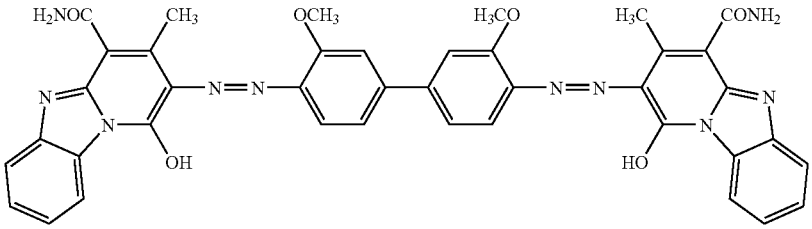
(2-17)
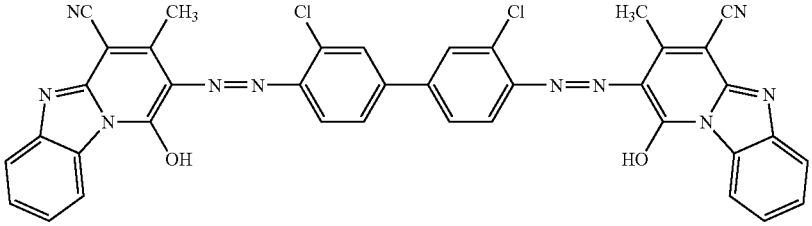
(2-18)
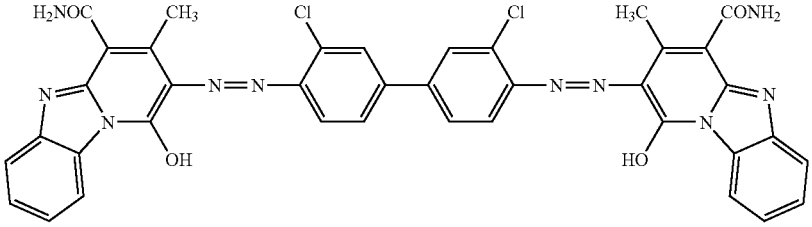
(2-19)
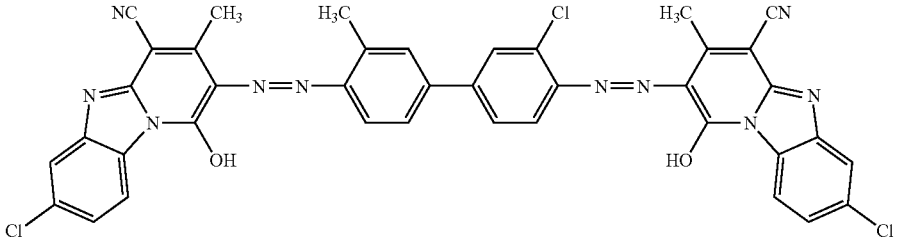
(2-20)
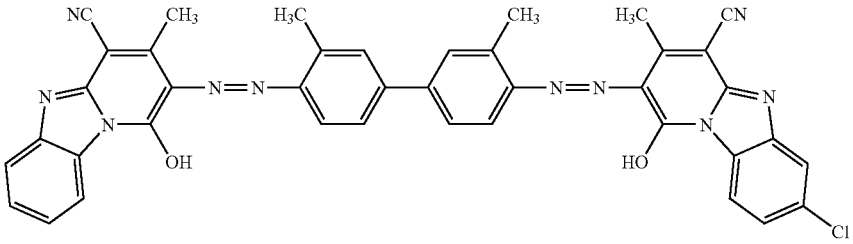

-continued (2-21)

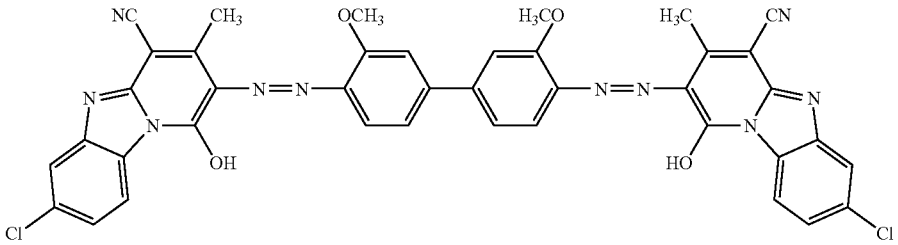

(2-22)

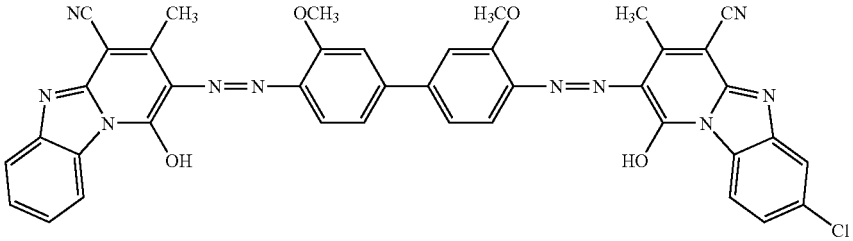

(2-23)

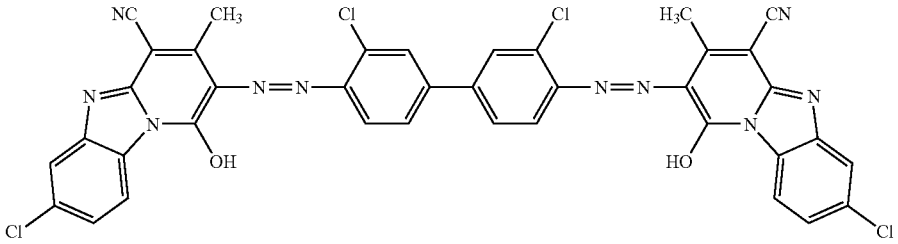

(2-24)

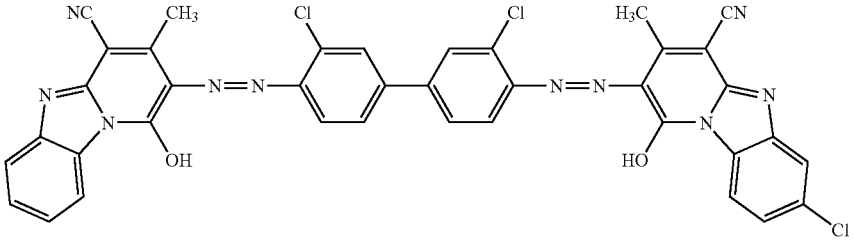

Selection of a solvent for the coating liquid is important to obtain a favorable dispersion condition and to form a homogeneous charge generation layer. The solvent for the coating liquid of the charge generation layer of embodiments of the invention may be selected from an aliphatic hydrocarbon halide, for example, methylene chloride or 1,2-dichloroethane, a hydrocarbon having an ether linkage, for example, tetrahydrofuran, a ketone, for example, acetone, methyl ethyl ketone, or cyclohexanone, an ester, for example, ethyl acetate, and an ether, for example, ethyl cellosolve (ethylene glycol monoethyl ether).

The ratio of amorphous titanylphthalocyanine to organic binder resin in the coating liquid is desired to be adjusted so that the ratio of the weight of the charge generation material to the organic binder resin in the coated and dried charge generation layer is in the range from 7/3 to 5/5.

The molecular weight distribution of the organic binder resin in a charge generation layer specific in an embodiment of the present invention may be attained by a single type of resin. However, a mixture of plural types of organic binder resins is preferable since the actual adjustment is easier using a mixture of the plural types of binder resins. A preferable mixture for enhancing the adhesion ability is obtained by mixing low molecular weight poly(vinyl acetal) having a polystyrene-converted weight average molecular weight of $1.0\times10^4$ to $7.0\times10^4$ with medium to high molecular weight poly(vinyl acetal) having a polystyrene-converted weight average molecular weight of $8\times10^4$ to $1.8\times10^5$. Each resin of such a mixture has a molecular weight distribution before mixing that has an overlapping range. Gel permeation chromatography of the mixture has demonstrated one continuous molecular weight distribution after mixing. In an embodiment of the present invention, the binder resin used in the charge generation layer is preferably a mixture of two or more types of resins that have different weight average molecular weights and have an overlapping range in their molecular weight distributions.

Here, two molecular weight distributions are defined to be 'overlapping' in an embodiment of the present invention, if the following condition (1) or (2) is satisfied.

Two distribution curves representing the two molecular weight distributions are normalized by converting the maximum detection intensity of each distribution to unity. 'A half-width region' for each distribution curve is defined by a region that is enclosed by the distribution curve; the half-width region has a width equal to a half-width of the distribution curve; and the center of the 'half-width region' is disposed at the peak position of the distribution curve.

Condition (1): Either a half-width region of one distribution curve overlaps with a tail portion of the other distribution curve, and the overlapped region has a finite area, or both of half-width regions overlap with a tail portion of the other distribution curve, and the overlapped region has a finite area.

Condition (2): The two normalized distribution curves have an intersection and the height of the intersection is not smaller than 1/e, where e is the base of the natural logarithm.

When at least one of the above two conditions is satisfied, the two molecular weight distributions are considered to have an overlapping molecular weight range.

A coating liquid for a charge generation layer is prepared by appropriately blending the above-described components. The coating liquid is adjusted to have a desired grain size of the pigment particles by a dispersion treatment using a sand mill or a paint shaker and is used for coating. A dip-coating method is preferable for mass production, though coating methods using a film coater, a bar coater, or an applicator may be applied as well.

A charge transport layer is formed by preparing a coating liquid by dissolving a charge transport material alone or a charge transport material and an organic binder resin in an appropriate solvent, and coating and drying the coating liquid on the charge generation layer by means of a dip-coating method. A hole transport or an electron transport substance is appropriately used as a charge transport material corresponding to a positive or negative charging system for a photoconductor in a copier, a printer, or a facsimile machine. Such a substance may be suitably selected from known substances exemplified in, for example, Borsemberger, P. M. and Weiss, D. S. eds. "Organic photoreceptors for imaging systems", Marcel Dekker Inc., 1993. Examples of hole transport material include hydrazone compounds, styryl compounds, diamine compounds, butadiene compounds, indole compounds, and a mixture of these materials. Examples of electron transport material include benzoquinone derivatives, phenanthrene quinone derivatives, stylbene quinone derivatives, and azo quinone derivatives. Specific examples of a structural formula of the hole transport material are shown below.

(3-1)

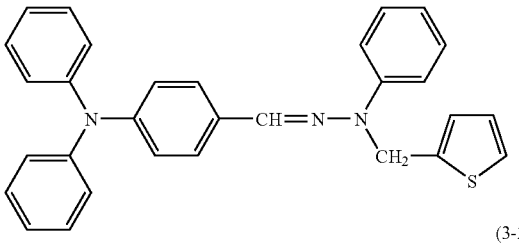

(3-2)

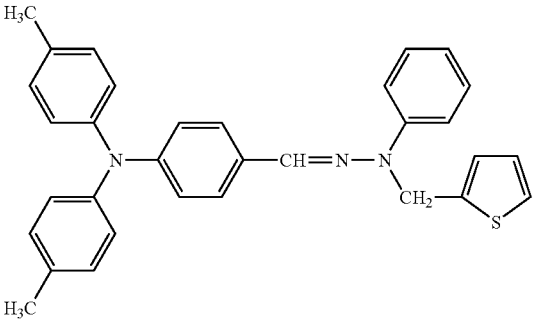

-continued (3-3)

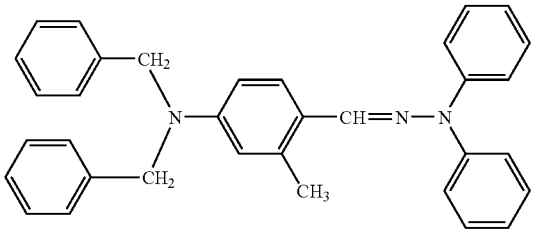

(3-4)

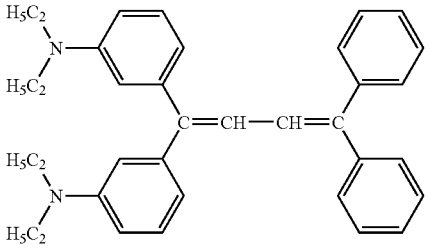

(3-5)

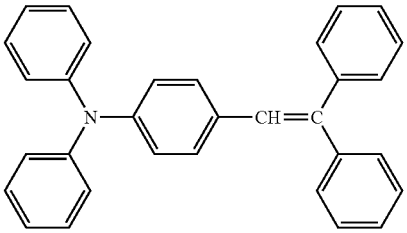

(3-6)

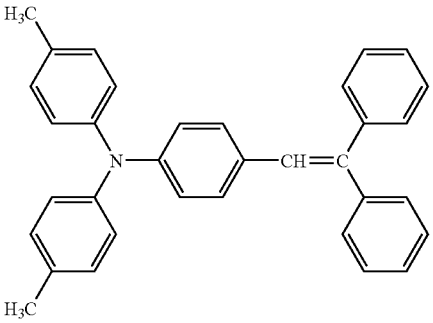

(3-7)

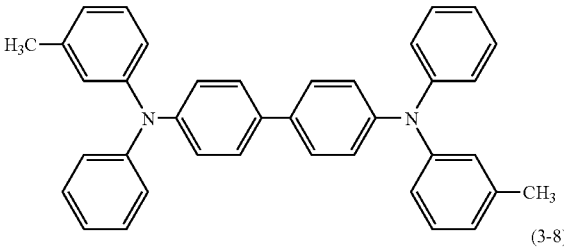

(3-8)

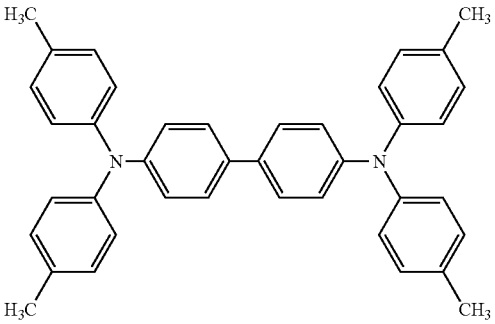

-continued (3-9)

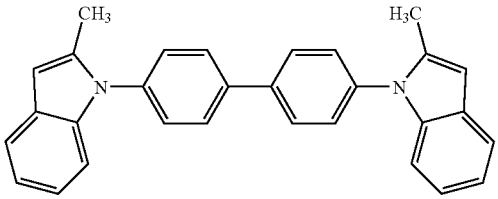

(3-10)

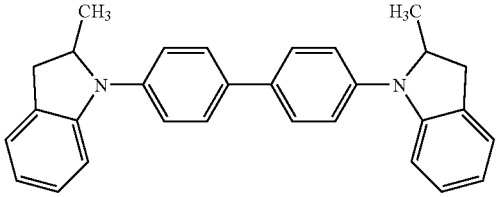

(3-11)

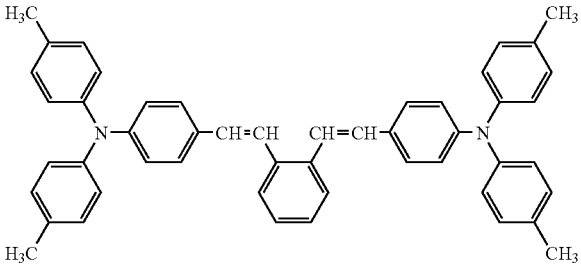

(3-12)

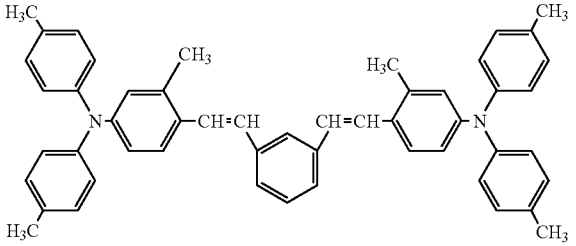

Polycarbonate polymer compounds are extensively used as an organic binder resin to form a charge transport layer in combination with the above-described charge transport material because they provide a desirable film thickness and resistance to wear. Such polycarbonate polymer compounds include bisphenol A, C, and Z, and a copolymer comprising monomer units of these polycarbonates. A proper molecular weight of the polycarbonate is in the range from 10,000 to 100,000. In addition, material that may be used for the organic binder resin in the charge transport layer includes polyethylene, polyphenylene ether, acrylic resin, polyester, polyamide, polyurethane, epoxy resin, poly(vinyl acetal), poly(vinyl butyral), phenoxy resin, silicone resin, poly(vinyl chloride), poly(vinylidene chloride), poly(vinyl acetate), cellulose resin, and copolymers of these substances. The thickness of the charge transport layer is preferably in the range from 3 to 50 μm, considering charging performance and wear resistance. The charge transport layer may further contain silicone oil to attain a smooth surface. A surface protective layer may be provided on the charge transport layer as required.

EXAMPLES

Advantages of a multi-layered organic electrophotographic photoconductor according to an embodiment of the present invention will be described in the following by comparing organic binder resins for the charge generation layer in Examples 1 through 24 according to embodiments of the invention with Comparative Examples 1 through 17 that are outside embodiments of the invention, comparing the undercoat layers including a thermosetting resin with the undercoat layers not including a thermosetting resin, and comparing the undercoat layers including titanium oxide with the undercoat layers not including the titanium oxide. Embodiments of the present invention are not limited to the examples described below.

Each photoconductor of Examples 1 through 5 comprises an organic binder resin of the charge generation layer with one of five different values of weight average molecular weight for embodiments of the present invention obtained by combining commercially available resins having different values of weight average molecular weight.

The photoconductors of Examples 6 to 10 comprise the same charge generation layers as the corresponding charge generation layers of Examples 1 through 5, and the undercoat layer, excluding titanium oxide, is different from the undercoat layer of the Examples 1 through 5, which is a mixture layer of a vinyl phenol resin, a melamine resin that is a thermosetting resin, and titanium oxide.

Each photoconductor of Examples 11 through 15 is the same as each of the Examples 1 through 5 except that the undercoat layer is composed of a brominated epoxy resin, which is a thermosetting resin, and titanium oxide.

Each photoconductor of Examples 16 through 20 is the same as each of the Examples 1 through 5 except that the undercoat layer is composed of only the brominated epoxy resin, which is a thermosetting resin.

Photoconductors of Comparative Examples 1 through 3 use the same undercoat layer as in Examples 1 through 5, but use organic binder resins of the charge generation layer, the resins having a weight average molecular weight or polydispersity that is outside the embodiments of the present invention.

Photoconductors of Comparative Examples 4 through 6 are the same as those of Comparative Examples 1 through 3 except that the undercoat layer is composed of only vinyl phenyl resin and melamine resin.

Photoconductors of Comparative Examples 7 through 9 are the same as those of Comparative Examples 1 through 3 except that the undercoat layer is composed of a nylon resin alone, which is a thermoplastic resin.

Photoconductors of Comparative Examples 10 through 12 are the same as those of Comparative Examples 1 through 3 except that the undercoat layer is composed of a brominated epoxy resin and titanium oxide.

Photoconductors of Comparative Examples 13 through 15 are the same as those of Comparative Examples 1 through 3 except that the undercoat layer is composed of a brominated epoxy resin alone.

Example 1

A conductive substrate used was an aluminum cylinder having an outer diameter of 24 mm and a length of 243 mm. An undercoat layer 5 μm thick was formed by dip-coating the outer surface of the aluminum cylinder with a coating liquid and drying at 145° C. for 30 min. The coating liquid for the undercoat layer was prepared by dispersing 1.5 kg of vinyl phenol resin MARUKA LYNCUR (registered trade name) MH-2 manufactured by Maruzen Petrochemical Co., Ltd., 1.5 kg of melamine resin UVAN (registered trade name) 20 HS manufactured by Mitsui Chemical, Inc., and 7 kg of amino silane-treated fine particles of titanium oxide in 75 kg of methanol and 15 kg of butanol.

A charge generation layer 0.2 μm thick was formed by dip-coating on the undercoat layer with a coating liquid and drying at 80° C. for 30 min. The coating liquid for the charge generation layer was prepared by dissolving and dispersing 0.1 kg of titanylphthalocyanine, having a molecular structure represented by chemical formula (2–3), and a crystal form classified as phase 11 studied by H. Hiller et al. disclosed in Z. Kristallogr. 159 p 173 (1982) and 0.1 kg of an organic binder resin of a mixture in a weight ratio of 3 to 1 of two types of poly(vinyl butyral) resins S-LEC (registered trade name) BH-3 and S-LEC BL-1, which are classified as poly(vinyl acetal) and manufactured by Sekisui Chemical Co. Ltd., in 9.8 kg of dichloromethane.

The molecular weight distribution of the mixed organic binder resin was measured by gel permeation chromatography using a column with a number of theoretical plates of 16,000, a differential refractive index detector, and an extraction solvent of chloroform, with a sample concentration of 1.0 mg/ml at a flow rate of 1.0 ml/min at a column temperature of 40° C. The measured molecular weight distribution indicated a polystyrene-converted weight average molecular weight of $1.7\times10^5$ and a polydispersity, which is a weight average molecular weight divided by a number average molecular weight, of 4.0.

A charge transport layer 20 μm thick was formed by dip-coating the charge generation layer with a coating liquid and drying at 90° C. for 60 min. The coating liquid for the charge transport layer was prepared by dissolving 0.9 kg of a stylbene compound represented by the chemical formula (3–11) and 1.1 kg of an organic binder resin of a polycarbonate resin TOUGHZET (registered trade name) B-500 manufactured by Idemitsu Kosan Co, Ltd., in 5.5 kg of dichloromethane. Thus, a multi-layered organic electrophotographic photoconductor was produced.

Example 2

An electrophotographic photoconductor was produced in the same manner as in Example 1, except that the organic binder resin used for the charge generation layer was 0.1 kg of a mixture in a weight ratio of 3 to 1 of S-LEC BM-1 and S-LEC BL-1, which are poly(vinyl butyral) resin classified as poly(vinyl acetal) and manufactured by Sekisui Chemical Co., Ltd. A polystyrene-converted weight average molecular weight of the mixed resin was $8.3\times10^4$, and the polydispersity was 5.0.

Example 3

An electrophotographic photoconductor was produced in the same manner as in Example 1, except that the organic binder resin used for the charge generation layer was 0.1 kg of a mixture in a weight ratio of 3 to 1 of S-LEC BH-3 and S-LEC BX-L, which are poly(vinyl butyral) resin classified as poly(vinyl acetal) and manufactured by Sekisui Chemical Co., Ltd. A polystyrene-converted weight average molecular weight of the mixed resin was $1.5\times10^5$, and the polydispersity was 4.9.

Example 4

An electrophotographic photoconductor was produced in the same manner as in Example 1, except that the organic binder resin used for the charge generation layer was 0.1 kg of a mixture in a weight ratio of 3 to 1 of Denka Butyral 3000-K manufactured by Denki Kagaku Kogyo KK and the S-LEC BL-1 manufactured by Sekisui Chemical Co., Ltd., both of the two being poly(vinyl butyral) resin classified as poly(vinyl acetal). A polystyrene-converted weight average molecular weight of the mixed resin was $8.3\times10^4$, and the polydispersity was 4.2.

Example 5

An electrophotographic photoconductor was produced in the same manner as in Example 1, except that the organic binder resin used for the charge generation layer was 0.1 kg of a mixture in a weight ratio of 1 to 1 of Denka Butyral 3000-K manufactured by Denki Kagaku Kogyo KK and the S-LEC BL-1 manufactured by Sekisui Chemical Co., Ltd., both of the two being poly(vinyl butyral) resin classified as poly(vinyl acetal). A polystyrene-converted weight average molecular weight of the mixed resin was $7.5\times10^4$, and the polydispersity was 4.2.

Comparative Example 1

An electrophotographic photoconductor was produced in the same manner as in Example 1, except that the organic binder resin used for the charge generation layer was 0.1 kg of only S-LEC BX-1 manufactured by Sekisui Chemical Co., Ltd. A polystyrene-converted weight average molecular weight of the resin was $1.8\times10^5$, and the polydispersity was 3.9.

Comparative Example 2

An electrophotographic photoconductor was produced in the same manner as in Example 1, except that the organic binder resin used for the charge generation layer was 0.1 kg of only S-LEC BL-1 manufactured by Sekisui Chemical Co., Ltd. A polystyrene-converted weight average molecular weight of the resin was $6.3\times10^4$, and the polydispersity was 4.1.

Comparative Example 3

An electrophotographic photoconductor was produced in the same manner as in Example 1, except that the organic binder resin used for the charge generation layer was 0.1 kg of a mixture in a weight ratio of 5 to 95 of the S-LEC BX-1 and the S-LEC BL-1 manufactured by Sekisui Chemical Co., Ltd. A polystyrene-converted weight average molecular weight of the mixed resin was $6.5\times10^4$, and the polydispersity was 3.9.

Example 6

A photoconductor was produced in the same manner as in Example 1, except that the undercoat layer lacks amino silane-treated fine particles of titanium oxide, and the thickness of the undercoat layer was 1 μm in order to adjust the electrical characteristics.

Example 7

A photoconductor was produced in the same manner as in Example 2, except that the undercoat layer lacks amino silane-treated fine particles of titanium oxide, and the thickness of the undercoat layer was 1 μm in order to adjust the electrical characteristics.

Example 8

A photoconductor was produced in the same manner as in Example 3, except that the undercoat layer lacks amino silane-treated fine particles of titanium oxide, and the thickness of the undercoat layer was 1 μm in order to adjust the electrical characteristics.

Example 9

A photoconductor was produced in the same manner as in Example 4, except that the undercoat layer lacks amino silane-treated fine particles of titanium oxide, and the thickness of the undercoat layer was 1 μm in order to adjust the electrical characteristics.

Example 10

A photoconductor was produced in the same manner as in Example 5, except that the undercoat layer lacks amino silane-treated fine particles of titanium oxide, and the thickness of the undercoat layer was 1 μm in order to adjust the electrical characteristics.

Comparative Example 4

A photoconductor was produced in the same manner as in Comparative Example 1, except that the undercoat layer lacks amino silane-treated fine particles of titanium oxide, and the thickness of the undercoat layer was 1 μm in order to adjust the electrical characteristics.

Comparative Example 5

A photoconductor was produced in the same manner as in Comparative Example 2, except that the undercoat layer lacks amino silane-treated fine particles of titanium oxide, and the thickness of the undercoat layer was 1 μm in order to adjust the electrical characteristics.

Comparative Example 6

A photoconductor was produced in the same manner as in Comparative Example 3, except that the undercoat layer lacks amino silane-treated fine particles of titanium oxide, and the thickness of the undercoat layer was 1 μm in order to adjust the electrical characteristics.

Comparative Example 7

A photoconductor was produced in the same manner as in Comparative Example 1, except that the undercoat layer 1 μm thick was formed by dip-coating an aluminum substrate with a coating liquid and drying at 80° C. for 30 min. The coating liquid for the undercoat layer was prepared by dissolving 0.5 kg of a nylon resin, CM8000 manufactured by Toray Industries Inc., in a mixed solvent of 14.75 kg of methanol and 74.75 kg of methylene chloride.

Comparative Example 8

A photoconductor was produced in the same manner as in Comparative Example 2, except that the undercoat layer was the same as that in Comparative Example 7.

Comparative Example 9

A photoconductor was produced in the same manner as in Comparative Example 3, except that the undercoat layer was the same as that in Comparative Example 7.

Example 11

A photoconductor was produced in the same manner as in Example 1, except that the undercoat layer 5 μm thick was formed by dip-coating a conductive substrate of an aluminum cylinder having an outer diameter of 24 mm and a length of 243 mm with a coating liquid and drying at 180° C. for 3 hr. The coating liquid for the undercoat layer was prepared by dispersing 1.8 kg of a low brominated epoxy resin, ARALDITE (registered trade name) AER8024 and 1.2 kg of a hardener HT9506, both supplied by Ciba Specialty Chemicals KK (Tokyo, Japan), and 7 kg of amino silane-treated fine particles of titanium oxide in 75 kg of dichloromethane and 15 kg of butanol.

Example 12

A photoconductor was produced in the same manner as in Example 2, except that the undercoat layer was the same as that in Example 11.

Example 13

A photoconductor was produced in the same manner as in Example 3, except that the undercoat layer was the same as that in Example 11.

Example 14

A photoconductor was produced in the same manner as in Example 4, except that the undercoat layer was the same as that in Example 11.

Example 15

A photoconductor was produced in the same manner as in Example 5, except that the undercoat layer was the same as that in Example 11.

Comparative Example 10

A photoconductor was produced in the same manner as in Comparative Example 1, except that the undercoat layer was the same as that in Example 11.

Comparative Example 11

A photoconductor was produced in the same manner as in Comparative Example 2, except that the undercoat layer was the same as that in Example 11.

Comparative Example 12

A photoconductor was produced in the same manner as in Comparative Example 3, except that the undercoat layer was the same as that in Example 11.

Example 16

A photoconductor was produced in the same manner as in Example 11, except that the undercoat layer lacks amino silane-treated fine particles of titanium oxide, and the thickness of the undercoat layer was 1 μm in order to adjust the electrical characteristics.

Example 17

A photoconductor was produced in the same manner as in Example 12, except that the undercoat layer lacks amino silane-treated fine particles of titanium oxide, and the thickness of the undercoat layer was 1 μm in order to adjust the electrical characteristics.

Example 18

A photoconductor was produced in the same manner as in Example 13, except that the undercoat layer lacks amino silane-treated fine particles of titanium oxide, and the thickness of the undercoat layer was 1 μm in order to adjust the electrical characteristics.

Example 19

A photoconductor was produced in the same manner as in Example 14, except that the undercoat layer lacks amino silane-treated fine particles of titanium oxide, and the thickness of the undercoat layer was 1 μm in order to adjust the electrical characteristics.

Example 20

A photoconductor was produced in the same manner as in Example 15, except that the undercoat layer lacks amino silane-treated fine particles of titanium oxide, and the thickness of the undercoat layer was 1 μm in order to adjust the electrical characteristics.

Comparative Example 13

A photoconductor was produced in the same manner as in Comparative Example 10, except that the undercoat layer lacks amino silane-treated fine particles of titanium oxide, and the thickness of the undercoat layer was 1 μm in order to adjust the electrical characteristics.

Comparative Example 14

A photoconductor was produced in the same manner as in Comparative Example 11, except that the undercoat layer lacks amino silane-treated fine particles of titanium oxide, and the thickness of the undercoat layer was 1 μm in order to adjust the electrical characteristics.

Comparative Example 15

A photoconductor was produced in the same manner as in Comparative Example 12, except that the undercoat layer lacks amino silane-treated fine particles of titanium oxide, and the thickness of the undercoat layer was 1 μm in order to adjust the electrical characteristics.

Example 21

A photoconductor was produced in the same manner as in Example 1, except that the weight ratio of the titanylphthalocyanine to the mixed resin in the charge generation layer was titanylphthalocyanine 7.0 (or 0.14 kg) to mixed resin 3.0 (or 0.06 kg).

Example 22

A photoconductor was produced in the same manner as in Example 1, except that the weight ratio of the titanylphthalocyanine to the mixed resin in the charge generation layer was titanylphthalocyanine 6.5 (or 0.13 kg) to mixed resin 3.5 (or 0.07 kg).

Example 23

A photoconductor was produced in the same manner as in Example 1, except that the weight ratio of the titanylphthalocyanine to the mixed resin in the charge generation layer was titanylphthalocyanine 6.0 (or 0.12 kg) to mixed resin 4.0 (or 0.08 kg).

Example 24

A photoconductor was produced in the same manner as in Example 1, except that the weight ratio of the titanylphthalocyanine to the mixed resin in the charge generation layer was titanylphthalocyanine 5.5 (or 0.11 kg) to mixed resin 4.5 (or 0.09 kg).

Comparative Example 16

A photoconductor was produced in the same manner as in Example 1, except that the weight ratio of the titanylphthalocyanine to the mixed resin in the charge generation layer was titanylphthalocyanine 7.5 (or 0.15 kg) to mixed resin 2.5 (or 0.05 kg).

Comparative Example 17

A photoconductor was produced in the same manner as in Example 1, except that the weight ratio of the titanylphthalocyanine to the mixed resin in the charge generation layer was titanylphthalocyanine 4.5 (or 0.09 kg) to mixed resin 5.5 (or 0.11 kg).

Electrophotographic characteristics of the photoconductors of Examples 1 through 20 and Comparative Examples 1 through 15 were evaluated by the following method. After charging the photoconductor surface by corona discharge in the dark to −650 V, a surface potential $V_0$ was measured immediately after the stop of the corona discharge. Subsequently, a surface potential $V_5$ was measured after leaving in the dark for 5 seconds to obtain a potential retention rate $V_{k5}$ (%) at 5 sec after the charging defined by equation (1) below.

$$V_{k5}=V_5/V_0\times 100 \quad (1)$$

The photoconductor surface was charged again to −650 V by corona discharge and then, the corona discharge was stopped. When the surface potential was decayed to −600 V, the photoconductor surface was irradiated by monochromatic light at the wavelength of 780 nm obtained from light emitted from a halogen lamp and passed through a bandpass filter with a radiation density of 1.0 μW/cm$^2$ at the photoconductor surface. The quantity of exposed light $E_{100}$ (μJ/

$cm^2$ ) was measured that is an amount of light energy received by the conductor surface during decay of the surface potential from −600 V to −100 V. While a reciprocal of the amount of exposed light is proportional to sensitivity, the quantity $E_{100}$ is often used as a measure of sensitivity, and called as "sensitivity" in the following description. Table 1 shows the initial electrical characteristics of the photoconductors of Examples 1 through 20 and Comparative Examples 1 through 15.

TABLE 1

| | undercoat layer | retention rate $V_{k5}$ (%) | sensitivity $E_{100}$ ($\mu J/cm^2$) | weight average molecular weight ($10^4$) (*1) | poly-dispersity (*2) |
|---|---|---|---|---|---|
| Example 1 | vinyl phenol | 98.0 | 0.55 | 17.0 | 4.0 |
| Example 2 | & melamine | 97.5 | 0.58 | 8.3 | 5.0 |
| Example 3 | resin | 96.0 | 0.60 | 15.0 | 4.9 |
| Example 4 | plus | 97.0 | 0.53 | 8.3 | 4.2 |
| Example 5 | titanium | 97.5 | 0.56 | 7.5 | 4.2 |
| Comp Example 1 | oxide | 96.0 | 0.52 | 18.0 | 3.9 |
| Comp Example 2 | | 96.5 | 0.61 | 6.3 | 4.1 |
| Comp Example 3 | | 97.0 | 0.54 | 6.5 | 3.9 |
| Example 6 | vinyl phenol | 96.0 | 0.54 | 17.0 | 4.0 |
| Example 7 | & melamine | 95.3 | 0.54 | 8.3 | 5.0 |
| Example 8 | resin | 94.5 | 0.57 | 15.0 | 4.9 |
| Example 9 | | 95.5 | 0.50 | 8.3 | 4.2 |
| Example 10 | | 94.5 | 0.53 | 7.5 | 4.2 |
| Comp Example 4 | | 95.0 | 0.55 | 18.0 | 3.9 |
| Comp Example 5 | | 94.5 | 0.59 | 6.3 | 4.1 |
| Comp Example 6 | | 93.9 | 0.52 | 6.5 | 3.9 |
| Comp Example 7 | nylon resin | 95.2 | 0.57 | 18.0 | 3.9 |
| Comp Example 8 | alone | 94.8 | 0.56 | 6.3 | 4.1 |
| Comp Example 9 | | 94.2 | 0.54 | 6.5 | 3.9 |
| Example 11 | brominated | 96.9 | 0.51 | 17.0 | 4.0 |
| Example 12 | epoxy resin | 97.5 | 0.53 | 8.3 | 5.0 |
| Example 13 | plus | 95.9 | 0.52 | 15.0 | 4.9 |
| Example 14 | titanium | 96.6 | 0.54 | 8.3 | 4.2 |
| Example 15 | oxide | 97.5 | 0.52 | 7.5 | 4.2 |
| Comp Example 10 | | 96.9 | 0.58 | 18.0 | 3.9 |
| Comp Example 11 | | 96.8 | 0.55 | 6.3 | 4.1 |
| Comp Example 12 | | 97.2 | 0.53 | 6.5 | 3.9 |
| Example 16 | brominated | 95.5 | 0.53 | 17.0 | 4.0 |
| Example 17 | epoxy resin | 94.9 | 0.52 | 8.3 | 5.0 |
| Example 18 | | 95.1 | 0.51 | 15.0 | 4.9 |
| Example 19 | | 94.5 | 0.54 | 8.3 | 4.2 |
| Example 20 | | 95.0 | 0.55 | 7.5 | 4.2 |
| Comp Example 13 | | 95.1 | 0.56 | 18.0 | 3.9 |
| Comp Example 14 | | 94.8 | 0.57 | 6.3 | 4.1 |
| Comp Example 15 | | 94.2 | 0.54 | 6.5 | 3.9 |

(*1) Polystyrene-converted weight average molecular weight of the binder resin in the charge generation layer.
(*2) The polydispersity is defined by the weight average molecular weight divided by the number average molecular weight.

Adhesion ability tests were conducted on the charge generation layer of the photoconductors of Examples 1 through 20 and Comparative Examples 1 through 15 in accordance with the cross-cut tape test specified in JIS (Japan Industrial Standards) K5400. The interval of cut flaws in the cross-cut tape test was 1 mm. Test results are shown in Table 2. The evaluation point number was given according to the JIS K5400. The criterion to assign the evaluation point is referred to in the following.

Evaluation point 10—Each cut flaw is fine, both its sides are smooth and at the intersecting point of cut flaws and at each square, the sample is free from peeling.

Evaluation point 8—At the intersecting point of cut flaws the sample has a slight peeling, each square cut is free from peeling, and the area of loss part is within 5% of the total square area.

Evaluation point 6—At both sides and the intersecting point of cut flaws the sample has peeling, and the area of defect loss part is 5 to 15% of the total square area.

Evaluation point 4—The peeling width due to cut flaws is broad, and the area of defect loss part is 15 to 35% of the total square area.

Evaluation point 2—The peeling width due to cut flaws is broader than 4 points, and the area of defect loss part is 35 to 65% of the total square area.

Evaluation point 0—The peeling area is not less than 65% of the total square area.

The possibility of contamination of the coating liquid for a charge transport layer during dip-coating process for forming a charge transport layer was studied with an intermediate product of a photoconductor that already had a charge generation layer, but did not have a charge transport layer yet.

The above-mentioned intermediate product of a photoconductor was immersed and closed in a cylindrical vessel of aluminum filled with 1 liter of the coating liquid for the charge transport layer described in Example 1 for 3 days. Then, the coating liquid for the charge transport layer was taken out of the vessel and transferred into a transparent glass bottle to measure hue H of the coating liquid in the Muncel color system. Comparing the discoloration of the sample coating liquid with a virgin coating liquid, an extent of dissolution of a charge generation layer into the coating liquid for a charge transport layer was examined. The hue measurement was conducted using a spectroscopic color meter CR200 manufactured by Minolta Co. Ltd.

The Muncel color system arranges the three independent attributes of color, hue, lightness, and chroma, in sensory regular interval scales. JIS (Japanese Industrial Standards) Z 8721 specifies a representation method of the color system. Concerning the hue of the specification, there are 10 basic hues with 10 regular intervals in-between. The basic hues are red (5R), yellow-red (5YR), yellow (5Y), yellow-green (5GY), green (5G), blue-green (5BG), blue (5B), blue-purple (5PB), purple (5P), and red-purple (5RP).

As shown in Table 2, excellent results in the cross-cut tape test were obtained, and slight discoloration of the coating liquid for charge generation layer in the dissolution test and little contamination of the charge transport layer have been demonstrated in the Examples 1 through 20 that use an organic binder resin of a charge generation layer exhibiting the polydispersity in the distribution of polystyrene-converted molecular weight of at least 4.0 and the weight average molecular weight of at least $7.0\times10^4$. In addition, a tendency may be observed from the cross-cut tape test results that the adhesion ability was superior in Examples 1 through 5 and Examples 11 through 15 containing titanium oxide than in Examples 6 through 10 and Examples 16 through 20 lacking the titanium oxide.

TABLE 2

| | undercoat layer | point in cross-cut tape test | hue H of coating liquid for CGL(*3) | weight average molecular weight ($10^4$) (*1) | poly-dispersity (*2) |
|---|---|---|---|---|---|
| Example 1 | vinyl phenol | 10 | 8.7Y | 17.0 | 4.0 |
| Example 2 | & melamine | 10 | 9.0Y | 8.3 | 5.0 |
| Example 3 | resin | 10 | 8.9Y | 15.0 | 4.9 |
| Example 4 | plus | 10 | 9.2Y | 8.3 | 4.2 |
| Example 5 | titanium | 10 | 8.8Y | 7.5 | 4.2 |
| Comp Example 1 | oxide | 7 | 9.0Y | 18.0 | 3.9 |
| Comp Example 2 | | 8 | 3.0GY | 6.3 | 4.1 |
| Comp Example 3 | | 7 | 2.8GY | 6.5 | 3.9 |
| Example 6 | vinyl phenol | 8 | 8.8Y | 17.0 | 4.0 |
| Example 7 | & melamine | 9 | 9.1Y | 8.3 | 5.0 |
| Example 8 | resin | 9 | 9.0Y | 15.0 | 4.9 |
| Example 9 | | 8 | 9.2Y | 8.3 | 4.2 |
| Example 10 | | 9 | 8.9Y | 7.5 | 4.2 |
| Comp Example 4 | | 7 | 9.0Y | 18.0 | 3.9 |
| Comp Example 5 | | 8 | 3.0GY | 6.3 | 4.1 |
| Comp Example 6 | | 7 | 2.8GY | 6.5 | 3.9 |
| Comp Example 7 | nylon resin | 2 | 9.1Y | 18.0 | 3.9 |
| Comp Example 8 | alone | 8 | 3.2GY | 6.3 | 4.1 |
| Comp Example 9 | | 4 | 3.0GY | 6.5 | 3.9 |
| Example 11 | brominated | 10 | 8.6Y | 17.0 | 4.0 |
| Example 12 | epoxy resin | 10 | 9.0Y | 8.3 | 5.0 |
| Example 13 | plus | 10 | 8.3Y | 15.0 | 4.9 |
| Example 14 | titanium | 10 | 9.0Y | 8.3 | 4.2 |
| Example 15 | oxide | 10 | 8.5Y | 7.5 | 4.2 |
| Comp Example 10 | | 8 | 9.0Y | 18.0 | 3.9 |
| Comp Example 11 | | 9 | 2.8GY | 6.3 | 4.1 |
| Comp Example 12 | | 8 | 2.8GY | 6.5 | 3.9 |
| Example 16 | brominated | 8 | 8.5Y | 17.0 | 4.0 |
| Example 17 | epoxy resin | 9 | 9.2Y | 8.3 | 5.0 |
| Example 18 | | 9 | 8.7Y | 15.0 | 4.9 |
| Example 19 | | 8 | 9.4Y | 8.3 | 4.2 |
| Example 20 | | 9 | 8.9Y | 7.5 | 4.2 |
| Comp Example 13 | | 7 | 9.0Y | 18.0 | 3.9 |
| Comp Example 14 | | 8 | 3.0GY | 6.3 | 4.1 |
| Comp Example 15 | | 7 | 3.0GY | 6.5 | 3.9 |

(*1) Polystyrene-converted weight average molecular weight of the binder resin in the charge generation layer.
(*2) The polydispersity is defined by weight average molecular weight divided by number average molecular weight.
(*3)CGL: charge generation layer The hue of the coating liquid for the charge transport layer was assigned to a yellow color 8.5Y before use in the test. If the coating liquid for charge transport layer is contaminated by dissolution of the charge generation layer, the figure in this 8.5Y shifts to larger value. With further contamination, the hue index proceeds beyond 10Y and steps into 1GY of yellow-green phase, increasing the figure as the contamination progresses.

On the other hand, every one of Comparative Examples 1 through 15 that do not fulfill the requirements of the embodiments of the present invention demonstrated unsatisfactory results in at least one of the adhesion ability test or the dissolution test. Nevertheless, a little difference in adhesion ability was observed among the Comparative Examples depending on containment of titanium oxide or containment of thermosetting resin.

Comparative Examples 1, 4, 10, and 13 showed a slight discoloration of the coating liquid, Examples 1 through 5, but displayed poor adhesion ability. Comparative Examples 2, 3, 5, 6, 11, 12,14, and 15 showed poor adhesion ability and also significant discoloration of the coating liquid.

In the cross-cut tape test, every peeling occurred at the boundary between the undercoat layer and the charge generation layer.

Summarizing the above results, Examples 1 through 5and 11 through 15 are best in both adhesion ability and coating liquid discoloration. Examples 6 through 10 and 16 through 20, comprising an undercoat layer without titanium oxide are the second best. The foregoing Examples are within the scope of embodiments of the invention. The next favorable examples are Comparative Examples 1 through 3 and 10 through 12, followed by Comparative Examples 4 through 6 and 13 through 15. The poorest example group includes Comparative Examples 7 through 9, comprising an undercoat layer consisting of only a nylon resin, which is a thermoplastic resin, and a charge generation layer outside the scope of embodiments of the present invention.

In order to study the effect of the coating liquid for a charge transport layer contaminated with dissolution of a charge generation layer on electrical characteristics, electrical characteristics were measured again using a coating liquid for a charge transport layer after dissolution test. Intermediate products of the photoconductor were prepared forming an undercoat layer and a charge generation layer by each of the methods described in Examples 1 through 20 and Comparative Examples 1 through 15. Photoconductors were produced by forming on each intermediate product a charge transport layer using a coating liquid before and after the dissolution test with the same thickness, coating condition, and drying condition as in Example 1. Table 3 shows the measured sensitivity $E_{100}$ (μJ/cm$^2$) of the photoconductors using coating liquid after use in the dissolution test, as well as the difference in the sensitivity between before and after the dissolution test. Table 3 also gives potential retention rates before and after the dissolution test.

TABLE 3

| | undercoat layer | initial retention rate $V_{k5}$ (%) | after test retention rate $V_{k5}$ (%) | initial sensitivity $E_{100}$ (μJ/cm$^2$) | after test sensitivity $E_{100}$ (μJ/cm$^2$) | sensitivity difference (μJ cm$^2$) | weight average molecular weight ($10^4$)(*1) | poly-dispersity (*2) |
|---|---|---|---|---|---|---|---|---|
| Ex 1 | vinyl | 98.0 | 98.2 | 0.55 | 0.57 | 0.02 | 17.0 | 4.0 |
| Ex 2 | phenol | 97.5 | 97.3 | 0.58 | 0.56 | 0.02 | 8.3 | 5.0 |
| Ex 3 | & | 96.0 | 96.3 | 0.60 | 0.61 | 0.01 | 15.0 | 4.9 |
| Ex 4 | melamine | 97.0 | 97.2 | 0.53 | 0.55 | 0.02 | 8.3 | 4.2 |
| Ex 5 | resin | 97.5 | 98.3 | 0.56 | 0.55 | 0.01 | 7.5 | 4.2 |
| C Ex 1 | plus | 96.0 | 96.1 | 0.52 | 0.53 | 0.01 | 18.0 | 3.9 |
| C Ex 2 | titanium | 96.5 | 95.5 | 0.61 | 0.50 | 0.11 | 6.3 | 4.1 |
| C Ex 3 | oxide | 97.0 | 95.0 | 0.54 | 0.45 | 0.09 | 6.5 | 3.9 |
| Ex 6 | vinyl | 96.0 | 96.1 | 0.53 | 0.45 | 0.08 | 17.0 | 4.0 |
| Ex 7 | phenol | 95.3 | 95.4 | 0.54 | 0.46 | 0.08 | 8.3 | 5.0 |
| Ex 8 | & | 94.5 | 94.2 | 0.57 | 0.50 | 0.07 | 15.0 | 4.9 |
| Ex 9 | melamine | 95.5 | 95.3 | 0.50 | 0.43 | 0.07 | 8.3 | 4.2 |
| Ex 10 | resin | 94.5 | 96.2 | 0.53 | 0.45 | 0.08 | 7.5 | 4.2 |
| C Ex 4 | | 95.0 | 94.2 | 0.55 | 0.47 | 0.08 | 18.0 | 3.9 |
| C Ex 5 | | 94.5 | 93.7 | 0.59 | 0.30 | 0.29 | 6.3 | 4.1 |
| C Ex 6 | | 93.9 | 93.1 | 0.52 | 0.31 | 0.21 | 6.5 | 3.9 |
| C Ex 7 | nylon resin | 95.2 | 94.2 | 0.57 | 0.48 | 0.08 | 18.0 | 3.9 |
| C Ex 8 | alone | 94.8 | 93.7 | 0.56 | 0.40 | 0.16 | 6.3 | 4.1 |
| C Ex 9 | | 94.2 | 93.1 | 0.54 | 0.35 | 0.19 | 6.5 | 3.9 |
| Ex 11 | brominated | 96.9 | 96.1 | 0.51 | 0.49 | 0.02 | 17.0 | 4.0 |
| Ex 12 | epoxy resin | 97.5 | 95.4 | 0.53 | 0.49 | 0.04 | 8.3 | 5.0 |
| Ex 13 | plus | 95.9 | 94.2 | 0.52 | 0.48 | 0.04 | 15.0 | 4.9 |
| Ex 14 | titanium | 96.6 | 95.3 | 0.54 | 0.47 | 0.07 | 8.3 | 4.2 |
| Ex 15 | oxide | 97.5 | 96.2 | 0.52 | 0.48 | 0.04 | 7.5 | 4.2 |
| C Ex 10 | | 96.9 | 94.2 | 0.58 | 0.50 | 0.08 | 18.0 | 3.9 |
| C Ex 11 | | 96.8 | 93.7 | 0.55 | 0.41 | 0.14 | 6.3 | 4.1 |
| C Ex 12 | | 97.2 | 93.1 | 0.53 | 0.34 | 0.19 | 6.5 | 3.9 |
| Ex 16 | brominated | 95.5 | 95.0 | 0.53 | 0.48 | 0.05 | 17.0 | 4.0 |
| Ex 17 | epoxy resin | 94.9 | 94.4 | 0.52 | 0.48 | 0.04 | 8.3 | 5.0 |
| Ex 18 | | 95.1 | 94.2 | 0.51 | 0.49 | 0.02 | 15.0 | 4.9 |
| Ex 19 | | 94.5 | 93.9 | 0.54 | 0.47 | 0.07 | 8.3 | 4.2 |
| Ex 20 | | 95.0 | 94.8 | 0.55 | 0.48 | 0.07 | 7.5 | 4.2 |
| C Ex 13 | | 95.1 | 94.2 | 0.56 | 0.51 | 0.05 | 18.0 | 3.9 |
| C Ex 14 | | 94.8 | 93.5 | 0.57 | 0.43 | 0.14 | 6.3 | 4.1 |
| C Ex 15 | | 94.2 | 93.0 | 0.54 | 0.35 | 0.19 | 6.5 | 3.9 |

(*1) Polystyrene-converted weight average molecular weight of the binder resin in the charge generation layer.
(*2) The polydispersity is defined by the weight average molecular weight divided by the number average molecular weight.

As shown in Table 3, the photoconductors of Examples 1 through 20 showed a small sensitivity difference before and after the dissolution test in the range from 0.01 to 0.08 (μJ/cm$^2$). In contrast, Comparative Examples 2, 3, 5, 6, 8, 9, 11, 12, 14, and 15, which exhibited significant discoloration in Table 2, showed a large change in sensitivity of the photoconductors using a coating liquid for the charge transport layer before and after the dissolution test, the change being in the range from 0.09 to 0.29 (μJ/cm$^2$) and thus, the stability in mass production is insufficient. Correlation was observed between the sensitivity change and the degree of discoloration of each photoconductor.

For Example 1, Examples 21 through 24, and Comparative Examples 16 and 17, the hue H of the coating liquid for a charge transport layer was measured after a test of immersion in the coating liquid for the charge transport layer. The change of the bright potential ΔVL after 5,000 sheets of printings from the initial state was measured on the photoconductors of the above-mentioned Examples and Comparative Examples mounted on a practical machine. The results are shown in Table 4.

TABLE 4

| | pigment/resin ratio | hue H of coating liquid of CTL(*1) | bright potential variation ΔVL (V) |
|---|---|---|---|
| Example 21 | 7.0/3.0 | 9.0Y | 3 |
| Example 22 | 6.5/3.5 | 8.9Y | 5 |
| Example 23 | 6.0/4.0 | 8.9Y | 5 |
| Example 24 | 5.5/4.5 | 8.8Y | 6 |
| Example 1 | 5.0/5.0 | 8.7Y | 6 |
| Comp Ex 16 | 7.5/2.5 | 3.0GY | 3 |
| Comp Ex 17 | 4.5/5.5 | 8.5Y | 15 |

(*1)CTL: charge transport layer

Example 1 and Examples 21 through 24 showed little contamination of coating liquid for a charge transport layer and bright potential variation ΔVL after 5,000 sheets of continuous printings within an acceptable level. Although a favorable level of the bright potential variation after the continuous printings was shown in Comparative Example 16, in which a pigment/resin ratio in the charge generation layer is larger than the upper limit of the embodiments of the present invention, the Comparative Example 16 resulted in dissolution of significant amount of the pigment of the charge generation layer into the coating liquid for the charge transport layer and discoloration of the coating liquid because the proportion of the organic binder resin in the charge generation layer is small relative to the pigment particles. Sensitivity $E_{100}$ was also measured before and after the dissolution test like the data in Table 3, resulting in a large change of the sensitivity in Comparative Example 16, though not shown in Table 4. Comparative Example 17, which has a large resin proportion, or small pigment proportion, showed roughly a reverse tendency. The bright potential change ΔVL after the continuous printings was a large value of 15 volts.

A multi-layered organic electrophotographic photoconductor according to embodiments of the present invention comprises a conductive substrate and layers including an undercoat layer containing a thermosetting resin, a charge generation layer containing a charge generation material and an organic binder resin, and a charge transport layer laminated in the cited order on the substrate, wherein polydispersity defined by a ratio of weight average molecular weight to the number average molecular weight of the organic binder resin is at least 4.0, and the weight average molecular weight is at least $7.0\times10^4$ in distribution of polystyrene-converted molecular weight obtained by gel permeation chromatography. Because of this featured structure, a photoconductor according to embodiments of the invention exhibits excellent adhesion ability between the undercoat layer and the charge generation layer, and between the charge generation layer and the charge transport layer. The photoconductor according to embodiments of the invention is free of a problem of contamination of the coating liquid for a charge transport layer during a dip-coating process due to dissolution of the charge generation layer, and exhibits superior stability of the charge generation layer in mass production.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A multi-layered organic electrophotographic photoconductor comprising:

a conductive substrate and layers including an undercoat layer containing a thermosetting resin, a charge generation layer containing charge generation material and organic binder resin, and a charge transport layer laminated sequentially on the substrate, wherein polydispersity defined by a ratio of a weight average molecular weight to a number average molecular weight of the organic binder resin is at least 4.0, and the weight average molecular weight is at least $7.0\times10^4$ in a distribution of a polystyrene-converted molecular weight obtained by gel permeation chromatography, wherein the binder resin of the charge generation layer is substantially composed of poly(vinyl acetal) represented by the following chemical formula (1),

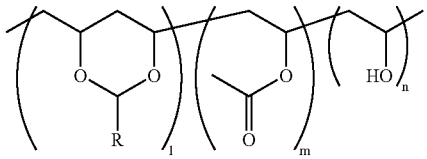

(1)

where i, m, and n are integers, and R is an alkyl group of one or more carbons or a hydrogen atom, and wherein the binder resin of the charge generation layer is substantially composed of a mixture of two or more poly(vinyl acetal) resins that have different weight average molecular weights and have an overlapping range in molecular weight distributions.

2. An electrophotographic photoconductor according to claim 1, wherein a ratio of a weight of the charge generation material to a weight of the binder resin in the charge generation layer is in a range from 7/3 to 5/5.

3. An electrophotographic photoconductor according to claim 1, wherein the undercoat layer has fine particles that perform functions of scattering exposure light and transporting photo-generated charges to the substrate.

4. The multi-layered organic electrophotographic photoconductor of claim 1, wherein the charge generation material is selected from the group consisting of phthalocyanine compounds and bisazo compounds.

5. The multi-layered organic electrophotographic photoconductor of claim 4, wherein the phthalocyanine compounds comprise a benzene ring having a substituent that is selected from the group consisting of a halogen and an alkyl group.

* * * * *

UNITED STATES PATENT AND TRADEMARK OFFICE

CERTIFICATE OF CORRECTION

PATENT NO. : 7,135,261 B2
APPLICATION NO. : 10/645879
DATED : November 14, 2006
INVENTOR(S) : Mikio Yamazaki It is certified that error appears in the above-identified patent and that said Letters Patent is hereby corrected as shown below:

Title Page, Column 2 item 56 (Other Publications), Line 13, Below "1991.*" insert --DERWENT ABSTRACT, Acc. No. 1992-392116, describing JP 05-263007 and U.S. 5,393,629 A, Nukada et al., Feb. 1995, copyright 2005.*--. (as a new entry).

Column 32, Line 42, change "i," to --I,--.

Signed and Sealed this

Eighth Day of May, 2007

JON W. DUDAS
*Director of the United States Patent and Trademark Office*